US010068680B2

(12) United States Patent
Mueller

(10) Patent No.: US 10,068,680 B2
(45) Date of Patent: Sep. 4, 2018

(54) CABLE HARNESS AND METHOD FOR PRODUCING THE CABLE HARNESS

(71) Applicant: LEONI BORDNETZ-SYSTEME GMBH, Kitzingen (DE)

(72) Inventor: Toni Mueller, Kitzingen (DE)

(73) Assignee: LEONI Bordnetz-Systeme GmbH, Kitzingen (DE)

( * ) Notice: Subject to any disclaimer, the term of this patent is extended or adjusted under 35 U.S.C. 154(b) by 9 days.

(21) Appl. No.: 15/438,975

(22) Filed: Feb. 22, 2017

(65) Prior Publication Data

US 2017/0162294 A1 Jun. 8, 2017

Related U.S. Application Data

(63) Continuation of application No. PCT/EP2015/068215, filed on Aug. 6, 2015.

(30) Foreign Application Priority Data

Aug. 22, 2014 (DE) ..... 10 2014 216 761

(51) Int. Cl.

| | |
|---|---|
| ***H01B 7/00*** | (2006.01) |
| ***H01B 13/012*** | (2006.01) |
| ***H01B 13/22*** | (2006.01) |
| ***H01B 7/02*** | (2006.01) |

(52) U.S. Cl.

CPC ..... *H01B 7/0045* (2013.01); *H01B 7/02* (2013.01); *H01B 13/01209* (2013.01); *H01B 13/228* (2013.01)

(58) Field of Classification Search

USPC ..... 174/113 R, 113

See application file for complete search history.

(56) References Cited

U.S. PATENT DOCUMENTS

| | | | | |
|---|---|---|---|---|
| 3,753,826 | A * | 8/1973 | Plummer | D21H 15/06 156/277 |
| 4,835,054 | A * | 5/1989 | Scarpa | H01B 7/22 174/136 |
| 4,874,447 | A * | 10/1989 | Hazelton | D04H 1/56 156/167 |
| 6,936,553 | B2 | 8/2005 | Von Samson-Himmelstjerna | |
| 8,088,315 | B2 | 1/2012 | Torres et al. | |
| 2009/0036014 | A1 * | 2/2009 | Torres | C09K 3/30 442/327 |

(Continued)

FOREIGN PATENT DOCUMENTS

| | | |
|---|---|---|
| DE | 1674703 U | 4/1954 |
| DE | 6607335 U | 2/1971 |

(Continued)

*Primary Examiner* — William H Mayo, III
*Assistant Examiner* — Krystal Robinson
(74) *Attorney, Agent, or Firm* — Laurence A. Greenberg; Werner H. Stemer; Ralph E. Locher

(57) ABSTRACT

A method for producing a cable harness, in particular for the motor vehicle industry, includes combining a plurality of individual lines into a line bundle. The line bundle is provided with a bundling element. The bundling element is constructed as a textile-like fiber interlacement or weave which is produced by applying a suspension including fibers and a binder to the line bundle. A cable harness produced by the method is also provided.

7 Claims, 1 Drawing Sheet

(56) References Cited

U.S. PATENT DOCUMENTS

| | | | | |
|---|---|---|---|---|
| 2011/0244747 | A1* | 10/2011 | Ushikai | B60R 16/0207 442/302 |
| 2011/0275268 | A1* | 11/2011 | Harris | H02G 3/0481 442/319 |
| 2013/0008686 | A1 | 1/2013 | Igarashi et al. | |
| 2014/0105769 | A1 | 4/2014 | Kim | |

FOREIGN PATENT DOCUMENTS

| | | | |
|---|---|---|---|
| DE | 3601116 | A1 | 7/1987 |
| DE | 4100111 | C1 | 7/1992 |
| DE | 4321044 | A1 | 1/1995 |
| DE | 19937446 | A1 | 4/2000 |
| DE | 10149071 | A1 | 4/2003 |
| DE | 102004023334 | A1 | 12/2005 |
| DE | 112010005431 | T5 | 3/2013 |
| DE | 102013012996 | A1 | 4/2014 |
| EP | 1910600 | | 4/2008 |
| FR | 2138269 | A2 | 1/1973 |
| JP | 2009104889 | A | 5/2009 |

* cited by examiner

CABLE HARNESS AND METHOD FOR PRODUCING THE CABLE HARNESS

CROSS-REFERENCE TO RELATED APPLICATION

This is a continuation application, under 35 U.S.C. § 120, of copending International Application PCT/EP2015/068215, filed Aug. 6, 2015, which designated the United States; this application also claims the priority, under 35 U.S.C. § 119, of German Application DE 10 2014 216 761.2, filed Aug. 22, 2014; the prior applications are herewith incorporated by reference in their entirety.

BACKGROUND OF THE INVENTION

Field of the Invention

The invention relates to a method for producing a cable harness, in particular for the automotive sector, wherein a number of individual lines are combined to form one line bundle, and wherein the line bundle is provided with a bundling element. Moreover, the invention relates to a cable harness including a line bundle made from a number of individual lines and provided with a bundling element, such as is described, for example, in German Application DE 10 2004 023 334 A1.

In the context of the production of prefabricated cable harnesses, for example for the automotive sector, individual lines are often combined to form line bundles. That makes it possible to simplify inter alia the installation or the fitting of a respective prefabricated cable harness since only a small number of line bundles instead of many individual lines have to be laid or installed. Also, depending on the method, a certain dimensional stability is achieved by the bundling, which dimensional stability may be desirable in order, for example, to ensure that the lines, after installation in an automobile, do not come into contact with certain locations in the automobile. Moreover, the installation space available in particular in an automobile may be better utilized as a result of the bundling.

The correspondingly combined lines are typically held together as a bundle in that case with the aid of taping, wherein the taping is typically configured in that the respective lines are wrapped in an adhesive plastic or textile tape. Alternatively, cohesion of the individual lines of the line bundle is achieved with the aid of so-called corrugated tubes which are available as prefabricated components and into which the lines are threaded or are introduced, for example through a slot or some other opening. Moreover, it is known for the combined lines to be provided with a sheathing, that is to say, for example, to be insert molded in plastics. In some cases, tapings, corrugated tubes and sheathings are employed in combination, for example when a plurality of line bundles are to be combined in a further process step to form an even larger unit, that is to say to an even larger line bundle having even more lines.

Apart from classic taping, methods in which first of all a woven textile fabric or a non-woven is placed around the lines, and an adhesive, a resin or some other binding or solidification agent is then applied to the fabric or non-woven, in particular also for configuring a complete cable sheathing, are also known. Such methods may be derived, for example, from German Application DE 10 2013 012 996 A1, corresponding to U.S. Applications 2014/0105769 and 2016/0380494; from German Application DE 101 49 071 A1, corresponding to U.S. Pat. No. 6,936,553; or from German Application DE 199 37 446 A1, corresponding to U.S. Pat. Nos. 6,436,528 and 6,451,146.

Furthermore, classic (injection) molding is also known for configuring cable sheaths. According to German Application DE 43 21 044 A1, injection-molded bodies are injection molded onto the line bundle at discrete locations.

A substantial disadvantage of those methods is the issue that in particular the taping or the introduction of the lines into respective corrugated tubes usually has to be performed manually since respective operative steps cannot be readily automated. However, corresponding automation would be desirable since it can reduce inter alia the production costs for respective cable harnesses.

SUMMARY OF THE INVENTION

It is accordingly an object of the invention to provide a cable harness and a method for producing the cable harness, which overcome the hereinafore-mentioned disadvantages of the heretofore-known devices and methods of this general type.

With the foregoing and other objects in view there is provided, in accordance with the invention, a method for producing a cable harness, in particular a prefabricated cable harness, for example for the automotive sector, the aerospace sector or for the engineering sector. During the course of production in this case, a number of individual lines are combined to form one line bundle, and subsequently the line bundle is provided with a bundling element which is configured by a textile-type fiber interlacement, which holds together the lines in the line bundle as a line bundle.

The respective lines in this case are individual line cores that are provided with an insulation, or else line cables made up of a plurality of line cores, wherein it is also usually the case herein that the line cores are each provided with an insulation and wherein the line cores of the line cables moreover are provided with an additional insulating sheathing. Depending on the application purpose, solid-wire conductors or stranded conductors are provided as line cores, wherein in some cases both solid-wire conductors and stranded conductors are contained in one line bundle.

In order to form the bundling element and thus the textile-type fiber interlacement within the context of the production of the cable harness, a suspension which includes a binding agent and loose fibers is applied to the line bundle. The suspension in this case acts as a type of "textile fabric solution" which can be applied to arbitrarily shaped surfaces and which, by virtue of the "solvent" being extracted from the "textile fabric solution" is solidified or converted into a type of woven textile fabric, that is to say into a textile-type woven-fabric interlacement, in such a way that a dimensionally stable formation is thus produced. The solidification in this case is typically performed either by way of an active post-treatment such as, for example, by heating or radiation with UV light or else without any active post-treatment, for example by passive drying during a drying phase. Consequently, the textile-type fiber interlacement then bears on that surface to which the suspension has been applied, in such a way that the shape of the textile-type fiber interlacement and thus of the bundling element is automatically adapted to the geometry of the line bundle. The suspension is therefore generally a liquid, in particular of aqueous consistency, in which the fibers are contained.

As opposed to conventional methods, no complex laying up or wrapping of the line bundle is therefore necessary, as is the case for example when using taping or else woven textile fabrics or non-wovens. In the present case, the fibers are loosely contained in the suspension. This is understood to mean that the individual fibers are not interconnected so as to form a prefabricated (planar) formation, that is to say in particular they do not configure a woven fabric, knitted fabric or non-woven. The individual fibers therefore do not configure any shape. A textile formation is produced as a fiber interlacement, and thus the bundling element, only once the suspension has been applied and solidification has subsequently taken place.

A further advantage of the method described herein is to be seen in that the suspension is applied at room temperature, and thus no heating of the suspension is performed.

Furthermore, the suspension is also applied to the line bundle in a simple manner without a mold being required therefor. The application is performed in this case in particular by a method that is known, for example, for the application of paints, such as spraying, injecting, etc.

The fiber interlacement in this case is applied in particular only to discrete locations of the line bundle and specifically does not serve for completely sheathing the line bundle. In particular, a plurality of mutually spaced apart fiber interlacements are applied so as to be distributed across the length of the line bundle.

In this way, any arbitrary shape may thus be shrouded, sheathed, or else locally coated, using a corresponding textile-type fiber interlacement. The production process for producing the textile-type fiber interlacement is therefore relatively simple and, accordingly, for example the individual operative or productive steps may also be readily automated. As a result of the ready adaptability of the shape of the textile-type fiber interlacement, and in particular as a result of the ready adaptability to the most varied geometries and surface shapes, it is also possible for the textile-type fiber interlacements to replace not only classic tapings by the textile-type fiber interlacements, but moreover also the corrugated tubes and sheathings that are employed for bundling lines. Moreover, volumetric regions, that is to say, for example, cavities, may also be filled using the textile-type fiber interlacement, wherein, depending on the composition, the textile-type fiber interlacement is also suitable, in principle, for achieving a sealing effect and, on account thereof, for separating off two spatial regions from one another for example in a liquid-tight manner.

Furthermore, depending on the requirements, the bundling element is preferably produced by multiple applications of the suspension, optionally in an alternating manner with drying phases or post-treatments, or else by a sequence involving various suspensions being applied and post-treated. For example, bundling elements of different thicknesses can be formed by multiple applications of the same suspension, in such a way that a fiber interlacement which in terms of the geometric dimensions thereof is similar to taping according to the prior art is formed for example by a single application of the suspension, whereas a bundling element which is similar to a sheathing according to the prior art and has corresponding geometric dimensions is produced by multiple applications and optionally post-treatment.

Moreover, the physical properties of the fiber interlacement can be defined in a variable manner by way of an application of variable frequency, wherein the flexibility and the elasticity of the bundling element typically decreases and the rigidity increases as the number of applications increases. This effect can be additionally enhanced by using various suspensions which differ preferably in terms of the mixing ratios rather than in terms of the ingredients. However, a corresponding bundling element always has a thickness in the range between 0.1 mm and 20 mm, in particular between 0.2 and 5 mm.

It is moreover advantageous for the suspension to contain a solvent in which the binding agent is soluble, and for the solvent to be extracted from the suspension in the course of a post-treatment in such a way that the textile-type fiber interlacement forms as a result. In an advantageous refinement, a solvent which evaporates or volatizes at typical room conditions is then employed, in such a way that no active post-treatment is required for converting the suspension into the textile-type fiber interlacement and simple passive drying is sufficient, wherein furthermore preferably the room conditions are adapted for the benefit of more rapid drying in that for example the temperature is increased and/or an air flow is defined.

Irrespective of the details of the production process, bundling of the lines and the production of the bundling element are preferably performed in a partially or fully automated manner and moreover preferably in a delimited or closed-off operating region. This avoids, inter alia, any potential exposure of operating personnel.

It is furthermore advantageous in this case, in particular also with respect to automation, for the suspension to be sprayed onto the line bundle, wherein the suspension has a sufficiently high viscosity therefor in such a way that the suspension adheres to the line bundle, that is to say does not run, so to speak, and does not drip off.

It is favorable in this case, in terms of respective spraying, for an aerosol to be produced from the suspension and a propellant gas or propellant agent to be used, in such a way that the application of the suspension is performed in a manner similar to the application of a paint to a vehicle body.

Advantageous compositions of the aerosol and/or of the suspension are described in European Patent EP 1 910 600 B1, corresponding to U.S. Pat. No. 8,088,315, to which explicit reference is hereby made. Thus, the fibers preferably employed are, for example, cotton fibers, linen fibers or glass fibers, wherein more than 60% and preferably approximately 80% of the fibers have a length of less than 30 mm and in particular of between 0.02 mm and 10 mm. Moreover, the suspension in the most application cases contains two types of fibers, wherein one type is typically provided by polymer fibers. A thermoplastic elastomer block copolymer, that is to say, for example, polyvinyl acetate (PVAC) or polyvinyl butyral (PVB), is furthermore preferably employed as the binding agent or binder. For example, acetone methanol or ethyl acetate is used in turn as a thinner or solvent. Further variants, compositions and mixing ratios are described in more detail in European Patent EP 1 910 600 B1, corresponding to U.S. Pat. No. 8,088,315, and, accordingly, reference is made in this case to the respective disclosure of that publication.

As has already been mentioned earlier, the method proposed in this case permits the bundling element to be flexibly adapted to various requirements by virtue of its configuration being adapted correspondingly. Adaptation in this case is performed in particular by a corresponding modification of the application and optionally of the post-treatment. Depending on the application purpose, different, that is to say differently configured, bundling elements are also implemented in a single cable harness.

In this way, the suspension is applied for example in some cases in such a way that the bundling element is ultimately configured in the manner of a tape, for example with a tape thickness between 0.2 mm and 1 mm, and encloses the line bundle in an annular manner. In this case, the bundling element then acts locally in the manner of a cable tie or of a cable clip which bears preferably only on the line bundle, but does not compress the individual lines in relation to one another. In other cases, application is performed in such a manner that the bundling element is ultimately configured in the manner of a tape, for example with a tape thickness between 0.2 mm and 0.5 mm, and helically loops around a portion of the line bundle. This variant is advantageous in particular when a small number of fine or thin lines are to be held together in a bundle across a comparatively large portion.

If, in contrast, a plurality of comparatively thick lines or line cables are to be combined and held together, the bundling element is embodied preferably in the manner of a sheathing, for example with a jacket thickness between 2 mm and 10 mm, wherein to this end multiple applications of the suspension, optionally in an alternating manner with drying phases or post-treatments, are furthermore preferably performed.

Moreover, in some situations an application of the suspension is performed in such a manner that the bundling element is ultimately configured in the manner of a fork or a junction, by way of which at least one line of the line bundle is routed away from the rest of the lines, or else, as seen in the other way around, in which at least one line is added to an already configured line bundle.

Moreover, the method also permits the previously described variants to be combined or merged with one another, so as thus to form relatively complex structures.

It is always the case, however, that the method produces a textile-type fiber interlacement having a non-oriented or an amorphous fiber distribution. Although the textile-type fiber interlacement is thus more similar to a non-woven in terms of fiber distribution, fiber interlacement and fiber structure, the tear strength of the textile-type fiber interlacement is more comparable to that of a woven textile product. This is predominantly the result of the fiber composite being interspersed with a binder or binding agent, the latter reinforcing the cohesion between the individual fibers.

Depending on the composition of the suspension used, the volumetric proportion of the fibers in the textile-type fiber interlacement in this case is preferably more than 60%, in particular more than 75%, and in some cases more than 80%. In these cases, the fibers are not so much embedded in the binder as, rather, partially sheathed or impregnated with the binder in such a way that the structure of the textile-type fiber interlacement still shows up the individual fibers, the visual appearance in some cases being reminiscent of cotton candy.

The cohesion between the individual fibers is moreover typically significantly greater than the adhesive effect between the textile-type fiber interlacement and the surface onto which the suspension has been applied. Therefore, the textile-type fiber interlacement can typically be released from the surface without the textile-type fiber interlacement being damaged as a result. The latter can therefore be for example released from the surface retroactively and then displaced along the line bundle.

Moreover, the textile-type fiber interlacement in most cases is not only flexible but also elastic, wherein the elasticity in some cases is comparable with a so-called rubber-elastic band, in such a way that, for example if and when required, it is possible for further lines to be added retroactively to the line bundle and routed through the textile-type fiber interlacement. The textile-type fiber interlacement can be elongated in this case, preferably in the context of an elastic deformation, by more than 5% and in particular by more than 10%, in each case in relation to its extent in the direction of elongation. The respective elasticity is implemented in this case with the aid of elastic fibers and/or by using an elastic binder.

Since moreover an adhesive effect which causes adhesion to the surface of the line bundle is achieved in the case of the textile-type fiber interlacement if and when required by using the binder that intersperses the fiber composite, the textile-type fiber interlacement, as opposed to adhesive tapes, is typically uncoated, that is to say in particular does not have any unilaterally applied adhesive coating. Specifically, these adhesive coatings are often not as durable as desired, so that the effect wears off after some time, due to which the cohesion in the line bundle is lost. That issue does not typically arise in the case of the textile-type fiber interlacement.

A further bundling element, which is formed in a different manner and in particular as taping, is preferably provided in addition to the textile fiber interlacement. Specifically, the bundling element in this case is attached so as to be spaced apart from the fiber interlacement in the longitudinal direction of the line bundle. If and when required, it is also possible for the further bundling element to be additionally placed around the fiber interlacement.

In a preferred structural embodiment, the further bundling element in this case is attached in stressed, in particular flexurally stressed, regions of the line bundle. These are understood to be regions in which the line bundle has a bend or else a junction, or in which, in the employed state, flexural stress is to be expected, for example as a result of the line bundle moving as intended at the envisaged location of use.

With the objects of the invention in view, there is concomitantly provided a cable harness, in particular produced by the method according to the invention, comprising a line bundle including a plurality of individual lines and a bundling element. The bundling element is constructed as a textile-type fiber interlacement having a non-oriented fiber distribution bearing on the line bundle. The textile-type fiber interlacement includes a multiplicity of non-oriented individual fibers and a binding agent reinforcing cohesion of the individual fibers.

Other features which are considered as characteristic for the invention are set forth in the appended claims.

Although the invention is illustrated and described herein as embodied in a cable harness and a method for producing the cable harness, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
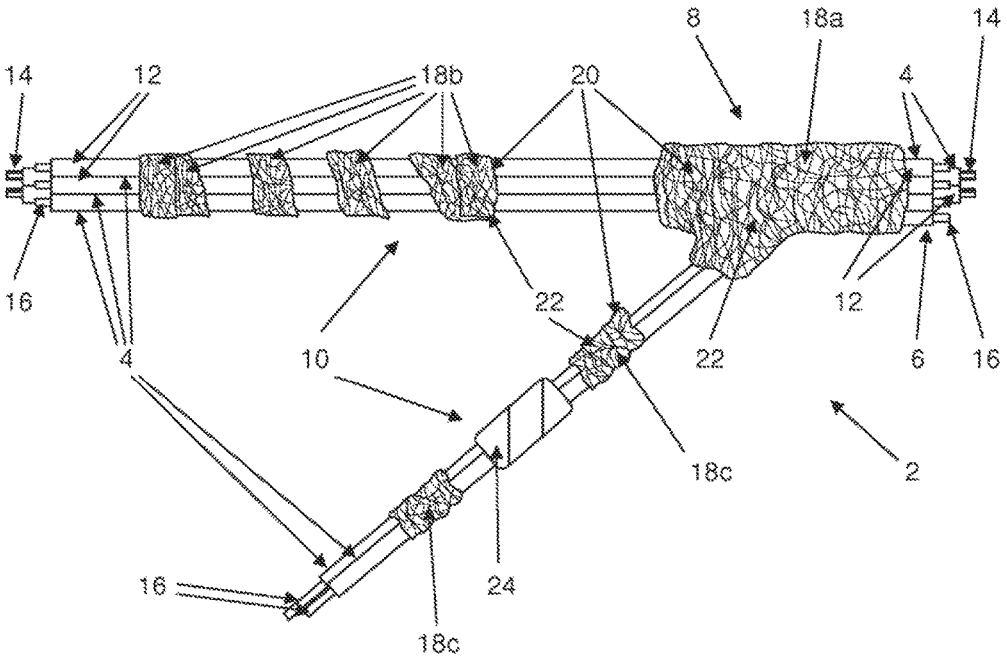
FIG. 1 is a diagrammatic, side-elevational view of a cable harness.

Referring now in detail to the figures of the drawings, in which equivalent parts are provided with the same reference signs, and first, particularly, to FIG. 1 thereof, there is seen a cable harness 2 that is described below by way of example, is part of a so-called wiring loom of an automobile and is accordingly installed in an automobile. The cable harness 2 in this case includes a plurality of individual lines 4 which are combined to form one line bundle 6, wherein the line bundle 6 is split into two part-bundles 10 at a junction 8.

Each part-bundle 10 in turn includes a plurality of lines 4 which, in the exemplary embodiment, are configured as individual line cores having an insulating sheathing 12. Some line cores in this case are constructed as stranded conductors 14 and others are constructed as solid-wire conductors 16.

The individual lines 4 of the line bundle 6, and the individual lines 4 of the two part-bundles 10, are each held together in the bundle with the aid of bundling elements 18 which are configured as textile-type fiber interlacements. One of the bundling elements 18*a* in this case is configured in the manner of a sheathing and accordingly has a thickness of 3 mm. Moreover, the junction 8 is implemented with the aid of this bundling element 18*a*, wherein the two part-bundles 10 are spaced apart in the region of the junction 8 by using the bundling element 18*a*.

The two part-bundles 10 are each also provided with bundling elements 18, wherein the part-bundle 10 having the larger number of lines 4 has a bundling element 18*b*, which is constructed in the manner of a tape and is routed helically around the part-bundle 10. The thickness of the tape-type bundling element 18*b* in this case is comparable to that of an adhesive textile tape and is approximately 0.5 mm. The part-bundle 10 having the smaller number of lines 4, by contrast, is provided with two bundling elements 18*c*, that are constructed in the manner of a tape and each encompass the respective part-bundle 10 in the manner of a cable clip. These bundling elements 18*c* in this case have a thickness of approximately 1 mm.

A further bundling element that is preferably configured as taping 24 is additionally illustrated in a diagrammatic manner in FIG. 1. The further bundling element is generally configured for absorbing greater forces than the textile fiber interlacement and is disposed, in particular, in stressed regions of the line bundle 6. In this way, for example, the region in which the taping 24 is disposed is a region in which the line bundle 6 is subjected to flexural stressing when it is used as intended.

Figure 2:
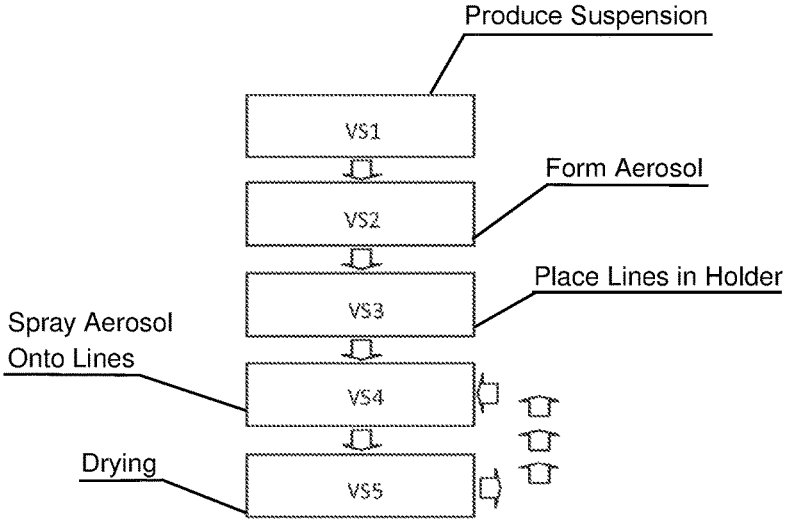
FIG. 2 is a flow diagram of a method for producing the cable harness.

Bundling of the individual lines 4 and the production of the respective bundling elements 18 is performed in a fully automated manner during production of the cable harness 2, wherein a suspension made up of a solvent, of a binding agent 20 that is soluble in the former, and of fibers 22 is produced in a first method step VS1. An aerosol is then formed from the suspension and a propellant in a subsequent method step VS2 according to FIG. 2, wherein, depending on the composition, one and the same component can also be used as a solvent and as a propellant, in which case the first two method steps VS1, VS2 basically coincide.

The exemplary embodiment described below is based on the formulation that is described as example 2 on page 9 of European Patent EP 1 910 600 B1, corresponding to U.S. Pat. No. 8,088,315, and which is incorporated by reference herein, wherein the exact formulation or composition is of no further relevance to the following description.

If, then, the suspension or the aerosol is available, the lines 4 that are provided for bundling are placed into a holder by using a robot arm in a further method step VS3. The aerosol is then sprayed onto the combined lines 4 in a subsequent method step VS4, wherein spraying is performed in such a manner that the adhering suspension already fundamentally replicates the shape which the respective bundling element 18 is intended to have in the end. This thus means that, for a tape-type bundling element 18*b* which is to be routed helically around the combined lines 4, the suspension is also applied helically to the respective lines 4.

After the application, drying in which the solvent volatizes is performed in a method step VS5, and this results in the textile-type fiber interlacement from the suspension. Depending on the desired thickness of the textile-type fiber interlacement, the method steps VS4 and VS5 are alternated a number of times, wherein the thickness of the fiber interlacement increases further with every application and drying procedure.

The invention is not limited to the exemplary embodiment as described above. Rather, it is also possible for other variants of the invention to be derived therefrom by a person skilled in the art without departing from the subject matter of the invention. In particular, all individual features that have been described in conjunction with the exemplary embodiment can also be combined with one another in some other manner without departing from the subject matter of the invention.

The invention claimed is:

1. A cable harness, comprising:

a line bundle including a plurality of individual lines and a bundling element;

said bundling element being constructed as a textile-type fiber interlacement having a non-oriented fiber distribution bearing on said line bundle;

said textile-type fiber interlacement including a solidified suspension of a multiplicity of non-oriented individual loose fibers and a binding agent reinforcing cohesion of said individual fibers; and said textile-type fiber interlacement being elastic and being configured to be elongated through elastic deformation by more than 5% relative to its extent in a direction of elongation.

2. The cable harness according to claim 1, wherein said fibers in said textile-type fiber interlacement have a volumetric proportion of more than 60%.

3. The cable harness according to claim 1, wherein said textile-type fiber interlacement is uncoated.

4. The cable harness according to claim 1, which further comprises a further bundling element in addition to said bundling element constructed as said textile-type fiber interlacement.

5. The cable harness according to claim 4, wherein said further bundling element is configured as taping attached around said line bundle.

6. The cable harness according to claim 4, wherein said further bundling element is at least one of spaced apart from said textile fiber interlacement or attached to flexurally stressed regions of said line bundle.

7. The cable harness according to claim 1, wherein said bundling element has characteristics of having been constructed by producing an aerosol from said suspension and from a propellant gas, spraying said suspension onto said line bundle by spraying said aerosol onto said line bundle and solidifying said suspension upon application to produce said textile-type fiber interlacement.

* * * * *